US011313647B1

(12) United States Patent
Lee

(10) Patent No.: US 11,313,647 B1
(45) Date of Patent: Apr. 26, 2022

(54) MULTI-MOA REFLEX SIGHT FOR FIREARMS

(71) Applicant: Strike Industries, Inc., Santa Ana, CA (US)

(72) Inventor: Shanyao Lee, Santa Ana, CA (US)

( * ) Notice: Subject to any disclaimer, the term of this patent is extended or adjusted under 35 U.S.C. 154(b) by 0 days.

(21) Appl. No.: 17/160,346

(22) Filed: Jan. 27, 2021

(51) Int. Cl.
*F41G 1/30* (2006.01)

(52) U.S. Cl.
CPC ..... *F41G 1/30* (2013.01)

(58) Field of Classification Search
CPC ..... F41G 1/30
USPC ..... 42/113
See application file for complete search history.

(56) References Cited

U.S. PATENT DOCUMENTS

2020/0278177 A1* 9/2020 Grace ..... F41G 1/30
2021/0207926 A1* 7/2021 Mikroulis ..... F41G 1/30
2021/0207928 A1* 7/2021 Brewer ..... F41G 11/002

* cited by examiner

*Primary Examiner* — Samir Abdosh
(74) *Attorney, Agent, or Firm* — Han IP PLLC; Andy M. Han

(57) ABSTRACT

An apparatus implementable on a firearm includes a lens, a light source, and a control unit coupled to control the light source. The light source is configured to project an image of an aim point onto the lens. In operation, the control unit is configured to vary a size of the image projected onto the lens by the light source without changing a shape or an outer contour of the image.

11 Claims, 7 Drawing Sheets

600

1 MOA

6 MOA

MULTI-MOA REFLEX SIGHT FOR FIREARMS

TECHNICAL FIELD

The present disclosure is generally related to firearm accessories and, more particularly, to a sight with light reflection indicator for firearms.

BACKGROUND

Unless otherwise indicated herein, approaches described in this section are not prior art to the claims listed below and are not admitted as prior art by inclusion in this section.

Reflex sights, or reflector sights, are widely used in the defense industries, shooting sports, as well as personal defense to assist target aiming. In principle, a reflex sight is an optical sight that allows the user to look through a partially reflecting lens and see an illuminated projection of an aim point (e.g., a dot or some geometric shape) superimposed on the field of view. The size of the aim point (e.g., a dot) more ore less impacts the efficiency in aiming and accuracy in shot placement. For example, a dot sized for 1 minute of angle (MOA) tends to be very small and can help the user to aim the target precisely; however, the small-sized dot tends to be difficult for human eyes to find. On the other hand, a dot sized for 6 MOA tends to be large and can be easily picked up by human eyes; however, the large-sized dot cannot provide the kind of pin-point precision in aiming as does a small-sized dot. Currently available reflex sights on the market are typically sold with a fixed size of aim point. As such, a user would need to buy multiple reflex sights each with a respective size of aim point in order to have different MOAs to suite different needs, but this could be cost prohibitive and hence not ideal. There is, therefore, a need for a solution of a new reflex sight design that provides a user the flexibility in varying the size of the aim point to suit the needs of the user to accommodate different usage scenarios.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose innovative designs of a reflex sight with an aim point the size of which is adjustable or otherwise variable. It is believed that the proposed designs can avoid or otherwise minimize aforementioned issues associated with conventional reflex sights.

In one aspect, an apparatus implementable on a firearm may include a reflex sight which may include a lens, a light source, and a control unit coupled to control the light source. The light source may be configured to project an image of an aim point onto the lens. In operation, the control unit may be configured to vary a size of the image projected onto the lens by the light source without changing a shape or an outer contour of the image.

In another aspect, an apparatus implementable on a firearm may include a reflex sight which may include a lens, a light source, and a control unit coupled to the light source. The light source may be configured to project an image of an aim point onto the lens. In different modes, the control unit may be configured to control the light source to light up different portions thereof to vary a size of the image projected onto the lens by the light source without changing a shape or an outer contour of the image.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
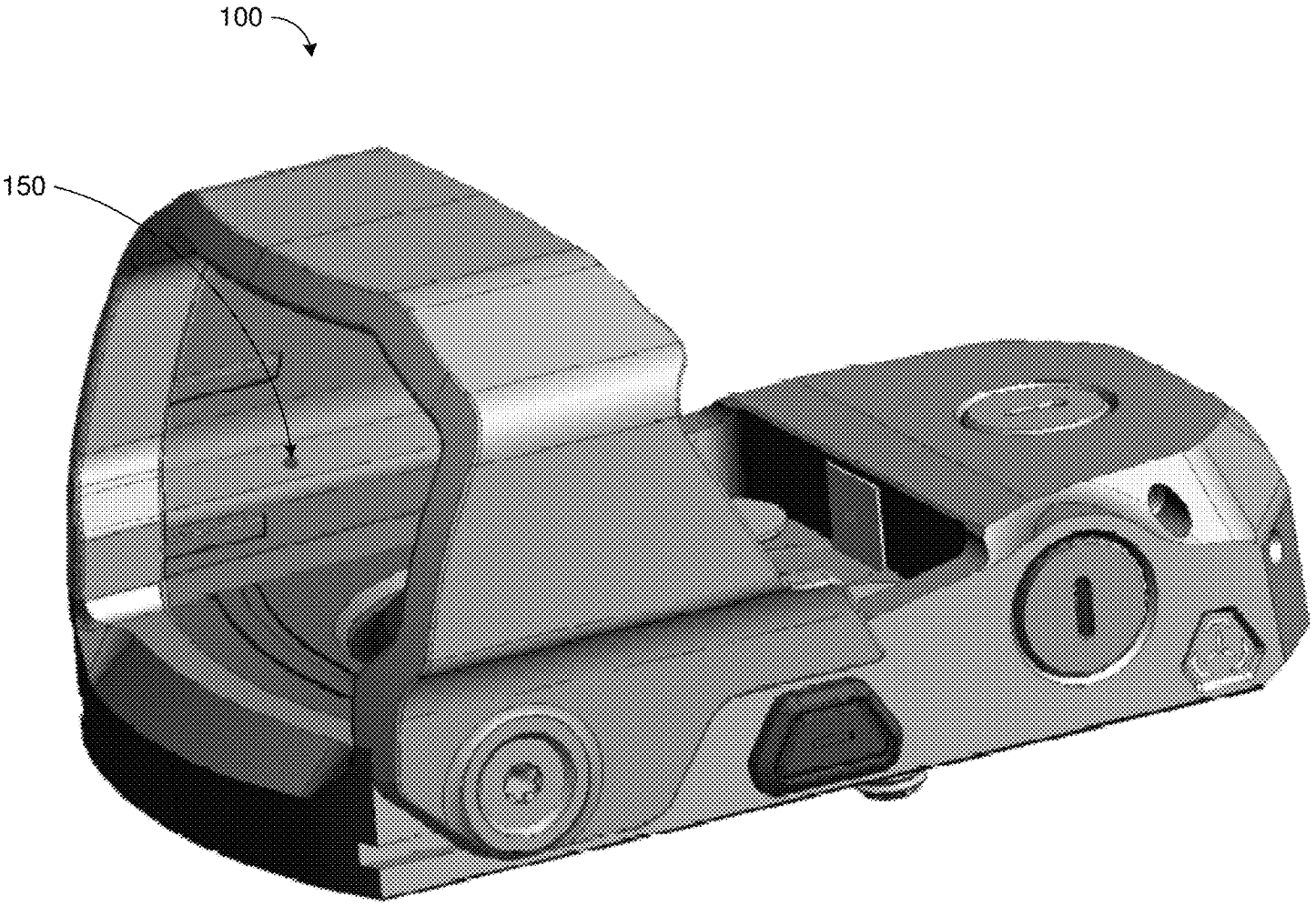
FIG. 1 is a diagram of an apparatus in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g., 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Figure 2:
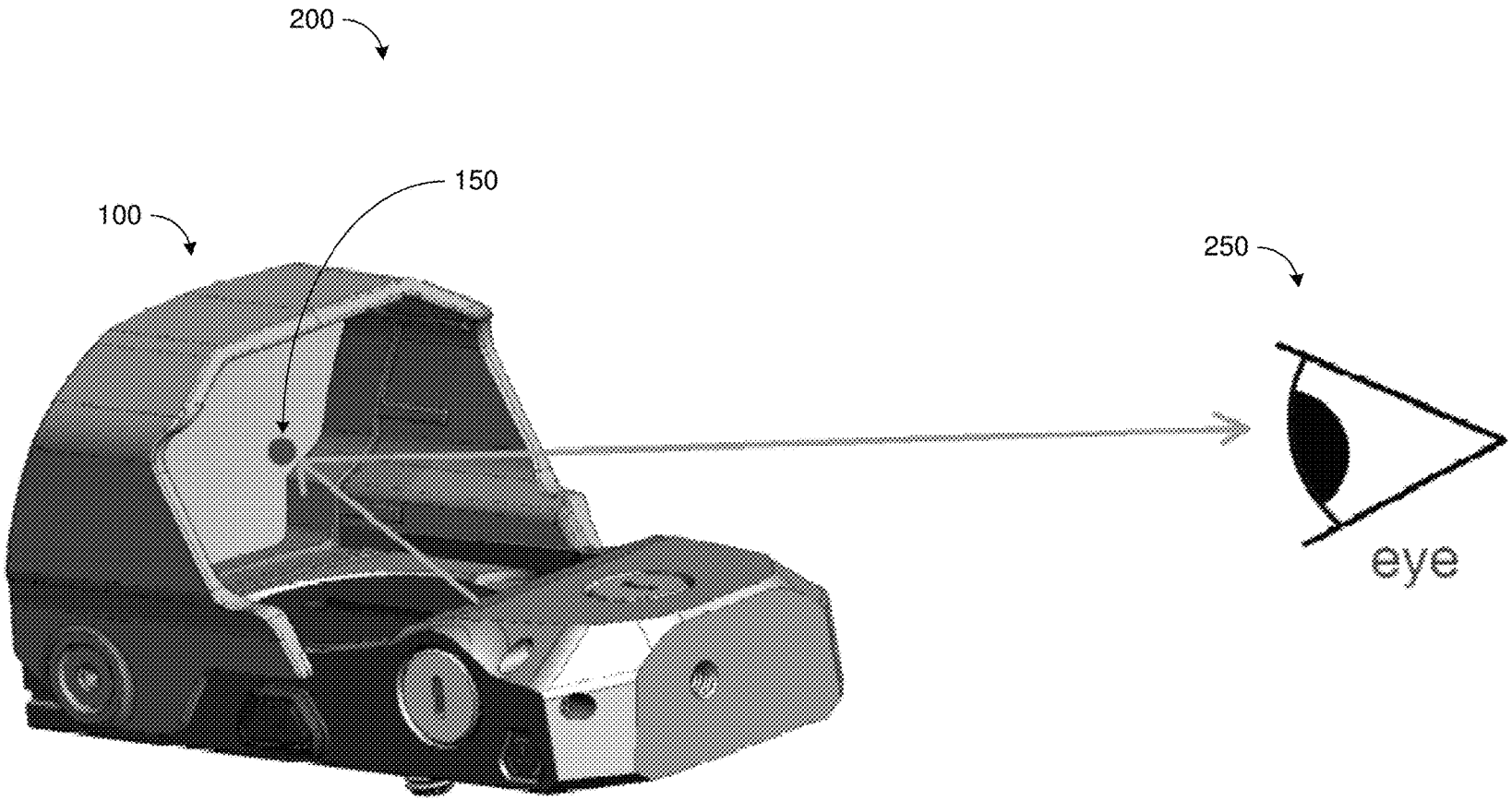
FIG. 2 is a diagram of an example scenario of an apparatus in operation in accordance with an implementation of the present disclosure.

FIG. 1 illustrates an apparatus 100 in accordance with an implementation of the present disclosure. Apparatus 100 may include a reflex sight capable of varying its MOA by varying a size of an image of an aim point 150. FIG. 2 illustrates an example scenario 200 of apparatus 100 in operation in accordance with an implementation of the present disclosure. In scenario 200, a user 250 (represented by an eye of user 250 in FIG. 2) can view aim point 150 projected by apparatus 100.

Figure 3:
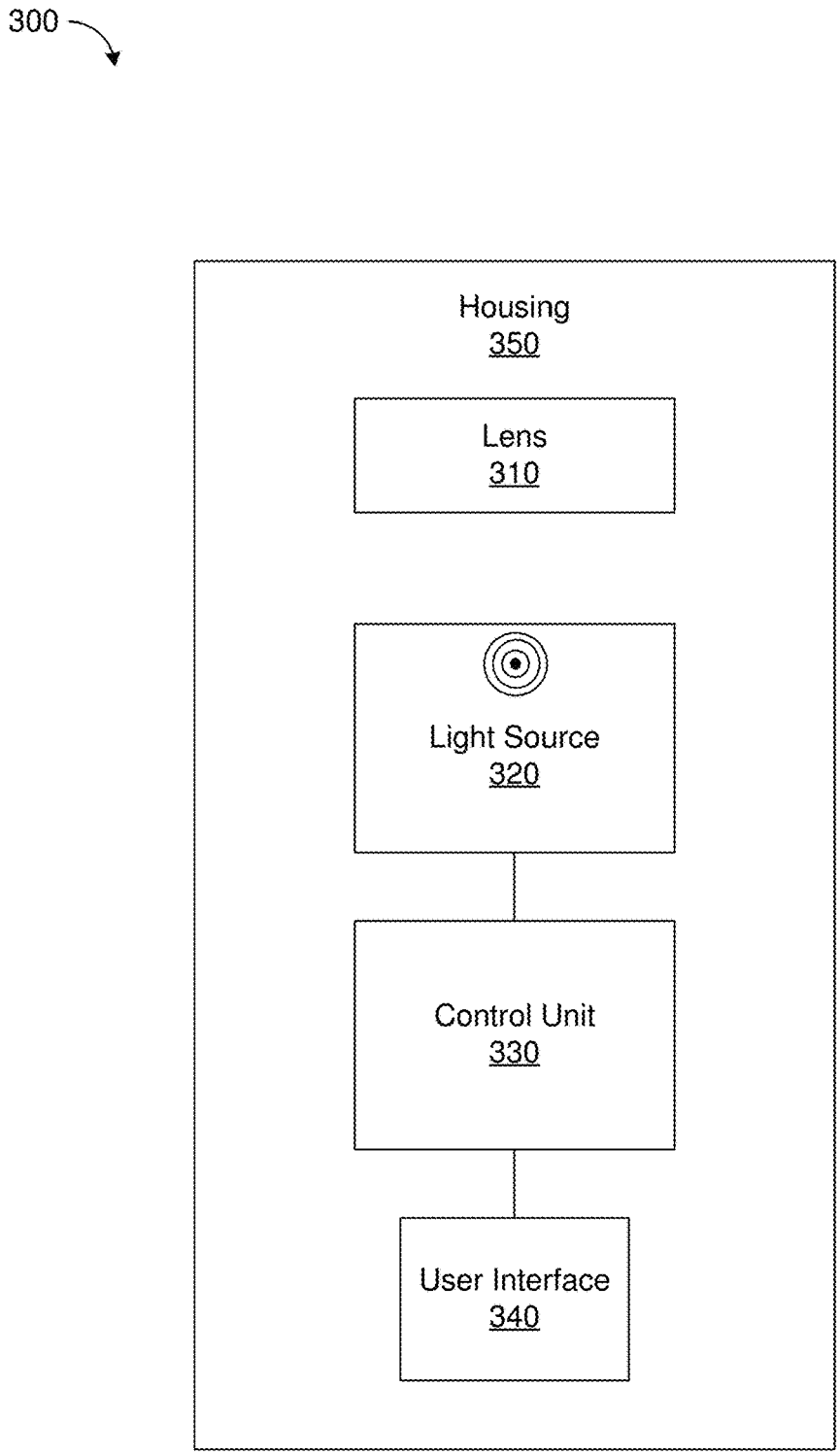
FIG. 3 is a schematic diagram of an apparatus in accordance with an implementation of the present disclosure.

FIG. 3 is a schematic diagram of an apparatus 300 in accordance with an implementation of the present disclosure. Apparatus 300 may be an example implementation of apparatus 100. Referring to FIG. 3, apparatus 300 may include a lens 310, a light source 320, and a control unit 330 coupled to control light source 320. Apparatus 300 may also include a housing 350 such that each of lens 310, light source 320 and control unit 330 may be disposed on or contained in housing 350. Light source 320 may include at least a light-emitting diode (LED) and may be configured to project an image of an aim point (e.g., aim point 150) onto lens 310. In operation, control unit 330 may be configured to vary a size of the image projected onto lens 310 by light source 320 without changing a shape or an outer contour of the image. For instance, in different modes, control unit 330 may be configured to control light source 320 to light up different portions thereof to vary a size of the image projected onto lens 310 by light source 320 without changing a shape or an outer contour of the image. That is, in case the aim point 150 is a circular dot, the shape or the outer contour would remain circular when the size of aim point 150 is varies from one size to another.

Under one proposed design, light source 320 may be fabricated to have different portions such as, for example and without limitation, one center portion (e.g., a dot or a polygon) and one or more concentric surrounding portions that surround the center portion. In operation, in a first mode, the center portion may be powered or otherwise lit up to project a first image which forms aim point 150 in a first size (e.g., 1 MOA). When switched to a second mode from the first mode, in addition to the center portion being lit up, a surrounding portion (e.g., a circle that surrounds or otherwise engulfs the dot) may also be powered or otherwise lit up to project a second image that surrounds the first image to form an image of aim point 150 in a second size (e.g., 6 MOA) which is larger than the first size, thereby resulting in the image of aim point 150 increasing from the first size to the second size. When switched back to the first mode from the second mode, the surrounding portion may be powered off so that only the center portion is powered or otherwise lit up, thereby resulting in the image of aim point 150 decreasing from the second size to the first size.

It is noteworthy that, while the shape or outer contour of the image of aim point 150 stays the same while the size is varied from one size to another, the center portion of the LED and its immediate adjacent surrounding portion may or may not be contiguous (or in full contact with each other). For instance, under one proposed design, when both the center portion and the surrounding portion are lit up, the resultant image may be a solid silhouette (e.g., a solid dot, a solid triangle, a solid square or a solid rectangle). Under another proposed design, when both the center portion and the surrounding portion are lit up, the resultant image may be a dot or polygon in the center with a circular ring or a polygonal ring around it with a gap (e.g., white space) in between. In both cases, however, the outer contour of the image of the aim point 150 may stay the same (e.g., round or polygonal) while the size is varies from one size to another.

Under one proposed design, light source 320 may include one single LED, and control unit 330 may be configured to control the single LED to perform certain operations. For instance, in a first mode, in a first mode, control unit 330 may control the LED to project a first image in a first size as the image of the aim point in a first size. In a second mode, control unit 330 may control the LED to project both of the first image and a second image to form the image of the aim point in a second size larger than the first size. The second image may surround the first image such that a combination of the first image and the second image forms a silhouette of the image of the aim point in the second size.

Under the proposed design, the first image may include a dot, and the second image may include a circle or a hollowed dot that surrounds the dot of the first image. Alternatively, the first image may include a polygon, and the second image may include a hollowed polygon that surrounds the polygon of the first image.

Under another proposed design, light source 320 may include one single LED, and control unit 330 may be configured to control the single LED to perform certain operations. For instance, in a first mode, control unit 330 may control the LED to project a first image as the image of the aim point in a first size. In a second mode, control unit 330 may control the LED to project both of the first image and a second image to form the image of the aim point in a second size larger than the first size. In a third mode, control unit 330 may control the LED to project all of the first image, the second image and a third image to form the image of the aim point in a third size larger than the second size.

The second image may surround the first image such that a combination of the first image and the second image forms a silhouette of the image of the aim point in the second size. The third image may surround the second image such that a combination of the first image, the second image and the third image forms the silhouette of the image of the aim point in the third size.

Under the proposed design, the first image may include a dot, the second image may include a first circle or a first hollowed dot that surrounds the dot of the first image, and wherein the third image comprises a second circle or a second hollowed dot that surrounds the first circle or the first hollowed dot of the second image. Alternatively, the first image may include a polygon, the second image may include a first hollowed dot that surrounds the polygon of the first image, and wherein the third image comprises a second polygon that surrounds the first polygon of the second image.

Under one proposed design, control unit 330 may be configured to vary the size of the image projected onto lens 310 to change between 1 MOA and 6 MOA. Alternatively, control unit 330 may be configured to vary the size of the image projected onto lens 310 to change between a first MOA and a second MOA, with the first MOA being relatively smaller (e.g., 0.5 MOA, 1 MOA or 2 MOA) and with the second MOA being relatively larger (e.g., 3 MOA, 4 MOA or 6 MOA).

Under one proposed design, apparatus 300 may further include a user interface 340 coupled to control unit 330 and configured to receive a user input (e.g., from user 250). In such cases, control unit 330 may be configured to vary the size of the image of the aim point (e.g., aim point 150) projected onto lens 310 by light source 320 based on the user input.

Figure 4:
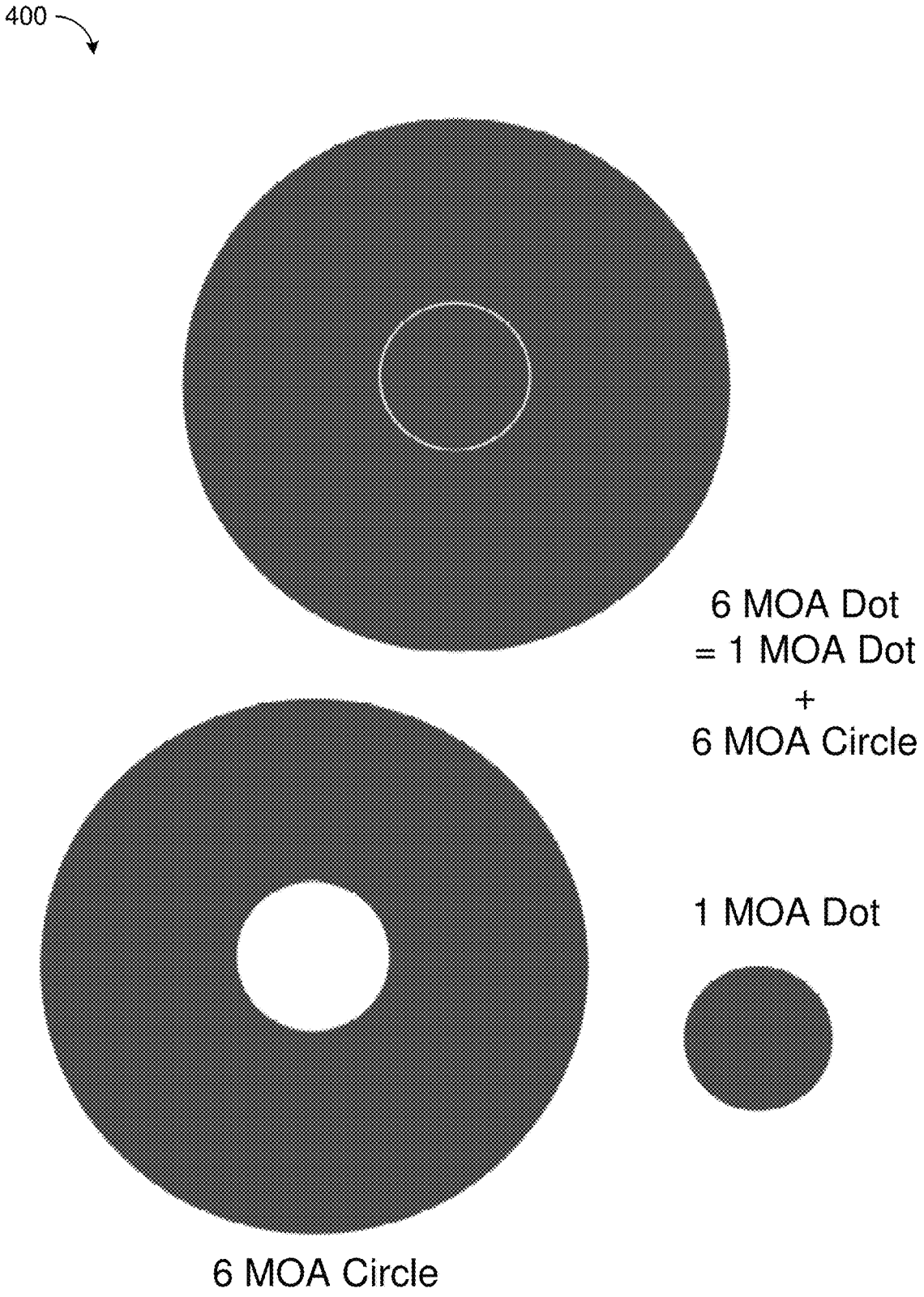
FIG. 4 is a diagram of an example of images projected by an apparatus in accordance with an implementation of the present disclosure.

FIG. 4 illustrates an example 400 of images projected by apparatus 300 in accordance with an implementation of the present disclosure. In example 400, light source 320 of apparatus 300 may, in a first mode, project an image of a 1 MOA dot onto lens 310. When switched from the first mode to a second mode, light source 320 may additionally project another image of a 6 MOA circle (or hollowed dot) that surrounds or otherwise engulfs the 1 MOA dot so that the combination of the two images form a 6 MOA dot which has the same shape or outer contour of the 1 MOA dot but in a larger size. Accordingly, apparatus 300 may vary the size of the image of the aim point (e.g., aim point 150) between the first mode (1 MOA) and the second mode (6 MOA) without changing the shape or outer contour of the aim point, which is a circular dot in example 300. Therefore, when switching from one mode to another mode, it would appear to user 250 that the shape or outer contour of the aim point 150 remains fixed while the size of aim point 150 increases or decreases (e.g., from 1 MOA to 6 MOA or from 6 MOA to 1 MOA).

Figure 5:
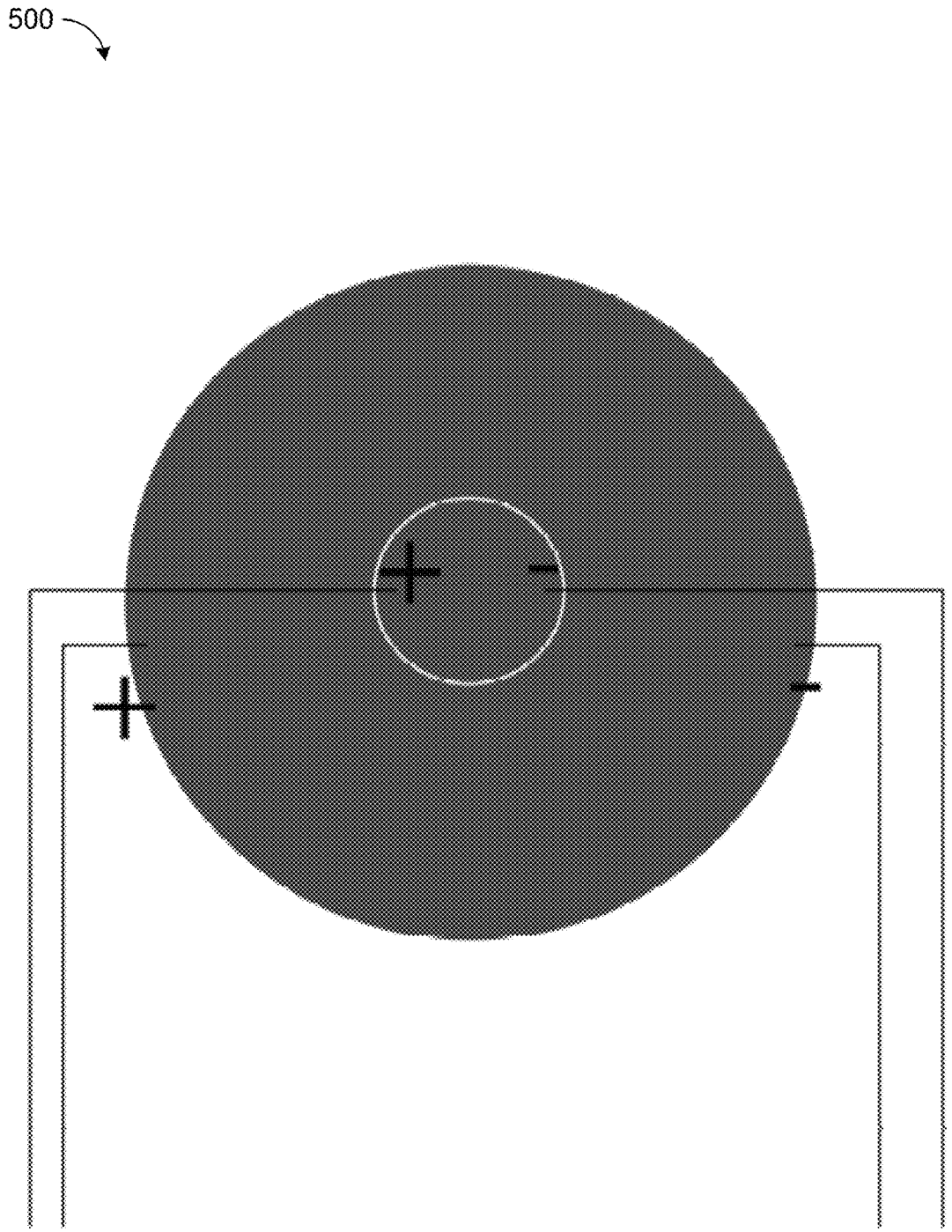
FIG. 5 is a diagram of an example of images projected by an apparatus in accordance with an implementation of the present disclosure.
Figure 6:
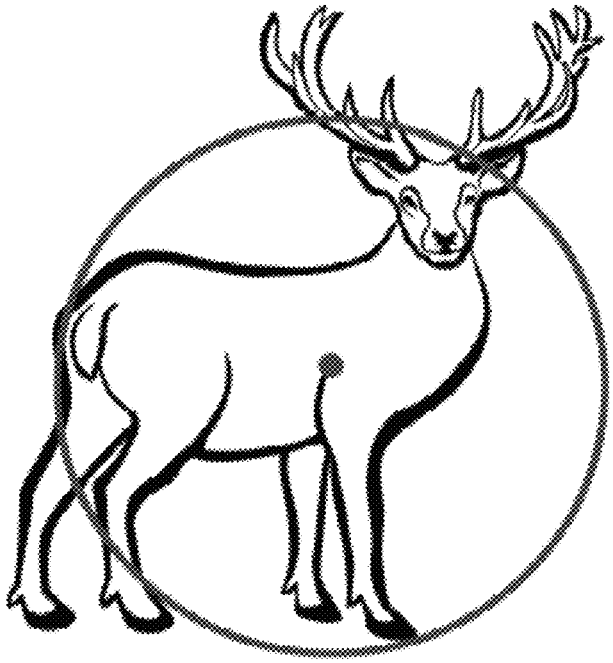
FIG. 6 is a diagram of an example of various MOAs projected by an apparatus in accordance with an implementation of the present disclosure.
Figure 6:
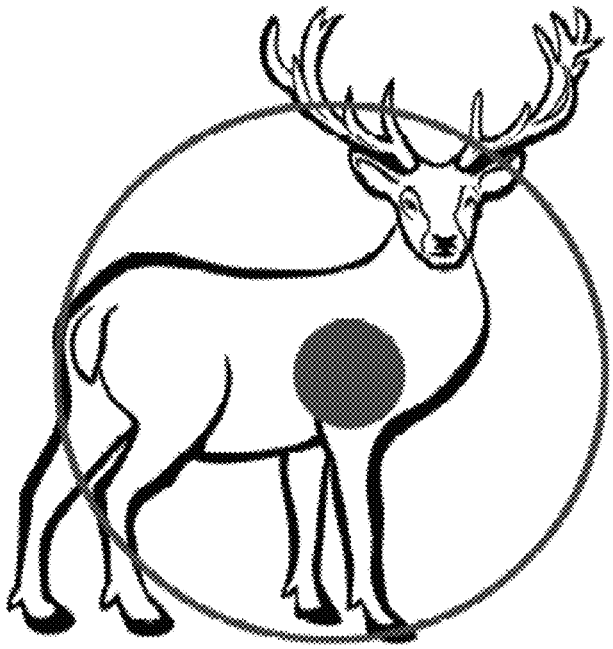

FIG. 5 illustrates an example 500 of images projected by light source 320 onto lens 310 in accordance with an implementation of the present disclosure. FIG. 6 illustrates an example 600 of various MOAs projected by light source 320 onto lens 310 and seen by user 250 when aiming a target.

Figure 7:
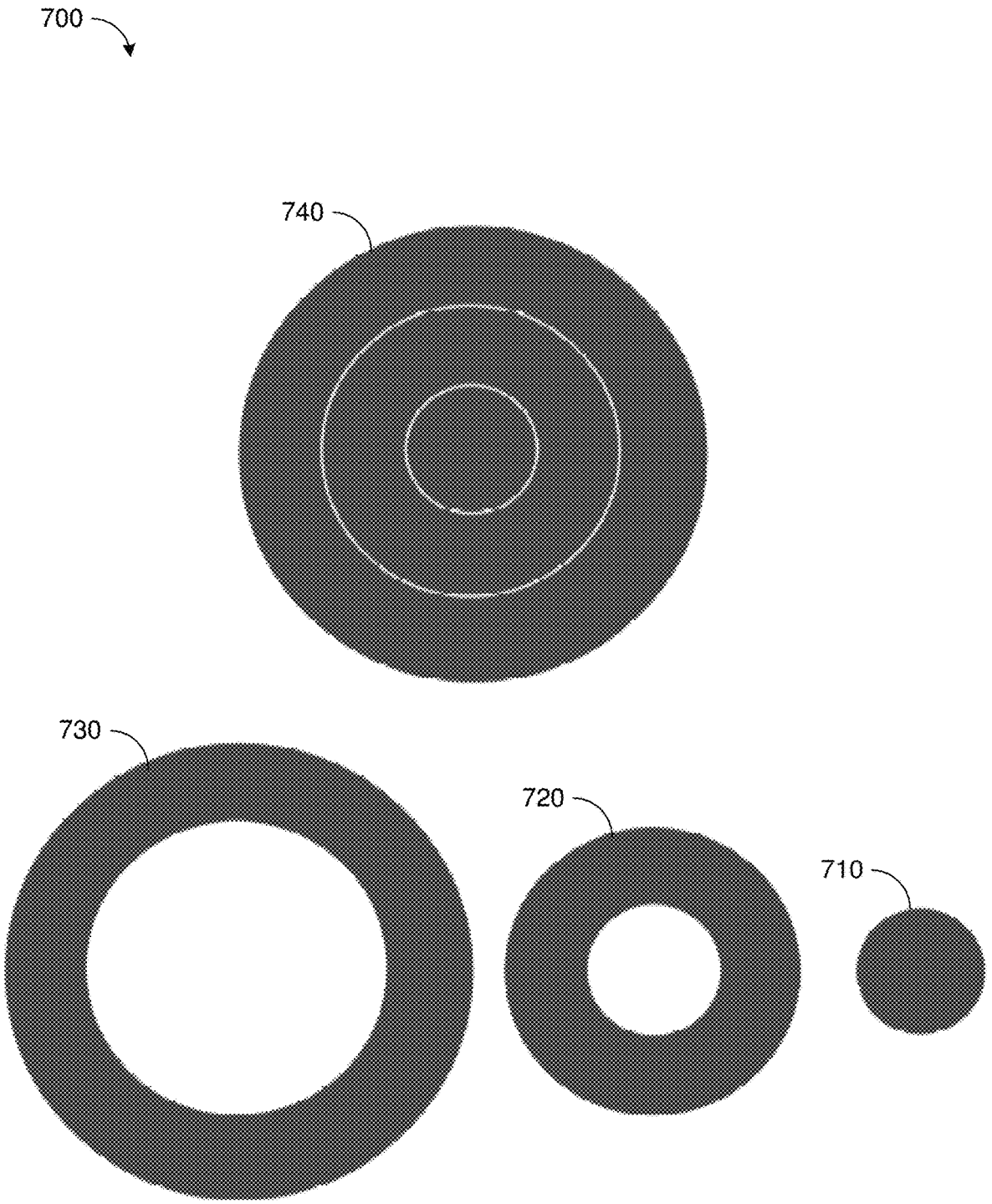
FIG. 7 is a diagram of another example of images projected by an apparatus in accordance with an implementation of the present disclosure.

FIG. 7 illustrates another example 700 of images projected by apparatus 300 in accordance with an implementation of the present disclosure. In example 700, light source 320 of apparatus 300 may, in a first mode, project an image of a dot in a first size onto lens 310. When switched from the first mode to a second mode, light source 320 may additionally project an image of a first circle (or a first hollowed dot) that surrounds or otherwise engulfs the original dot so that the combination of the two images form a larger dot in a second size greater than the first size which has the same shape or outer contour of the original dot but larger. When switched from the second mode to a third mode, light source 320 may further project an image of a second circle (or a second hollowed dot) that surrounds or otherwise engulfs the combination of the two images projected in the second mode so that the combination of the three images form an even larger dot in a third size greater than the second size which has the same shape or outer contour of the original dot but even larger. Example 700 illustrates the point that apparatus 300 may be capable of projecting more than two different MOAs, not just two MOAs. That is, although three different sizes (and, hence, three different MOAs) are shown in example 700, in various implementations there may be more or fewer number of sizes/MOAs that light source 320 may be configured to project.

It is noteworthy that the shape or outer contour of the image of aim point 150 is not limited to a circular dot. Under alternative designs, the shape or outer contour may be a polygon (e.g., a triangle, a square or a rectangle), and apparatus 300 may vary the size of the image of the aim point as a polygon without changing its shape or outer contour.

In view of the above, it is believed that apparatus 100 would provide a cost-effective solution with flexibility in varying the size of aim point to suit the particular needs of the user in different usage scenarios. Advantageously, with a reflex sight such as apparatus 100, the user may be able to adjust or otherwise vary the size of the MOA for his/her particular mission at the time without the need for swapping one reflex sight of one MOA with another reflex sight of another MOA.

Example Implementations

In view of the above, the proposed designs of a reflex sight may be implemented in many ways. For illustrative purposes and without limiting the scope of the present disclosure, a few example implementations of the proposed design are described below.

In one aspect, an apparatus implementable on a firearm may include a reflex sight which may include a lens, a light source, and a control unit coupled to control the light source. The light source may be configured to project an image of an aim point onto the lens. In operation, the control unit may be configured to vary a size of the image projected onto the lens by the light source without changing a shape or an outer contour of the image.

In some implementations, the light source may include an LED.

In some implementations, the LED may include one single LED, and the control unit may be configured to control the single LED to perform certain operations. For instance, in a first mode, in a first mode, the control unit may control the LED to project a first image in a first size as the image of the aim point in a first size. In a second mode, the control unit may control the LED to project both of the first image and a second image to form the image of the aim point in a second size larger than the first size. The second image may surround the first image such that a combination of the first image and the second image forms a silhouette of the image of the aim point in the second size. In some implementations, the first image may include a dot, and the second image may include a circle or a hollowed dot that surrounds the dot of the first image. Alternatively, the first image may include a polygon, and the second image may include a hollowed polygon that surrounds the polygon of the first image.

In some implementations, the LED may include one single LED, and the control unit may be configured to control the single LED to perform certain operations. For instance, in a first mode, the control unit may control the LED to project a first image as the image of the aim point in a first size. In a second mode, the control unit may control the LED to project both of the first image and a second image to form the image of the aim point in a second size larger than the first size. In a third mode, the control unit may control the LED to project all of the first image, the second image and a third image to form the image of the aim point in a third size larger than the second size. The second image may surround the first image such that a combination of the first image and the second image forms a silhouette of the image of the aim point in the second size. The third image may surround the second image such that a combination of the first image, the second image and the third image forms the silhouette of the image of the aim point in the third size. In some implementations, the first image may include a dot, the second image may include a first circle or a first hollowed dot that surrounds the dot of the first image, and wherein the third image comprises a second circle or a second hollowed dot that surrounds the first circle or the first hollowed dot of the second image. Alternatively, the first image may include a polygon, the second image may include a first hollowed dot that surrounds the polygon of the first image, and wherein the third image comprises a second polygon that surrounds the first polygon of the second image.

In some implementations, the control unit may be configured to vary the size of the image projected onto the lens to change between 1 MOA and 6 MOA.

In some implementations, the apparatus may further include a user interface coupled to the control unit and configured to receive a user input. In such cases, the control unit may be configured to vary the size of the image projected onto the lens by the light source based on the user input.

In another aspect, an apparatus implementable on a firearm may include a reflex sight which may include a lens, a light source, and a control unit coupled to the light source. The light source may be configured to project an image of an aim point onto the lens. In different modes, the control unit may be configured to control the light source to light up different portions thereof to vary a size of the image projected onto the lens by the light source without changing a shape or an outer contour of the image.

In some implementations, the light source may include on single LED.

In some implementations, the control unit may be configured to control the light source to perform certain operations. For instance, in a first mode, the control unit may control the light source to project a first image in a first size as the image of the aim point in a first size. In a second mode, the control unit may control the light source to project both of the first image and a second image to form the image of the aim point in a second size larger than the first size. The second image may surround the first image such that a combination of the first image and the second image forms a silhouette of the image of the aim point in the second size. In some implementations, the first image may include a dot, and the second image may include a circle or a hollowed dot that surrounds the dot of the first image. Alternatively, the first image may include a polygon, and the second image may include a hollowed polygon that surrounds the polygon of the first image.

In some implementations, the control unit may be configured to control the light source to perform certain operations. For instance, in a first mode, the control unit may control the light source to project a first image as the image of the aim point in a first size. In a second mode, the control unit may control the light source to project both of the first image and a second image to form the image of the aim point in a second size larger than the first size. In a third mode, the control unit may control the light source to project all of the first image, the second image and a third image to form the image of the aim point in a third size larger than the second size. The second image may surround the first image such that a combination of the first image and the second image forms a silhouette of the first image in the second size. The third image may surround the second image such that a combination of the first image, the second image and the third image forms the silhouette of the image of the aim point in the third size. In some implementations, the first image may include a dot, the second image may include a first circle or a first hollowed dot that surrounds the dot of the first image, and the third image may include a second circle or a second hollowed dot that surrounds the first circle or the first hollowed dot of the second image. Alternatively, the first image may include a polygon, the second image may include a first hollowed dot that surrounds the polygon of the first image, and the third image may include a second polygon that surrounds the first polygon of the second image.

In some implementations, the control unit may be configured to vary the size of the image projected onto the lens to change between 1 MOA and 6 MOA.

In some implementations, the apparatus may further include a user interface coupled to the control unit and configured to receive a user input. In such cases, the control unit may be configured to vary the size of the image projected onto the lens by the light source based on the user input.

ADDITIONAL NOTES

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. An apparatus implementable on a firearm, comprising:
a lens;
a light source configured to project an image of an aim point onto the lens; and
a control unit coupled to control the light source,
wherein, in operation, the control unit is configured to vary a size of the image projected onto the lens by the light source without changing a shape of the image,
wherein the light source comprises a light-emitting diode (LED),
wherein the LED comprises one single LED, and wherein the control unit is configured to control the single LED to perform operations comprising:
in a first mode, projecting a first image as the image of the aim point in a first size;
in a second mode, projecting both of the first image and a second image to form the image of the aim point in a second size larger than the first size; and
in a third mode, projecting all of the first image, the second image and a third image to form the image of the aim point in a third size larger than the second size,
wherein the second image surrounds the first image such that a combination of the first image and the second image forms a silhouette of the image of the aim point in the second size, and
wherein the third image surrounds the second image such that a combination of the first image, the second image and the third image forms the silhouette of the image of the aim point in the third size.

2. The apparatus of claim 1, wherein the first image comprises a dot, wherein the second image comprises a first circle or a first hollowed dot that surrounds the dot of the first image, and wherein the third image comprises a second circle or a second hollowed dot that surrounds the first circle or the first hollowed dot of the second image.

3. The apparatus of claim 1, wherein the first image comprises a polygon, wherein the second image comprises a first hollowed dot that surrounds the polygon of the first image, and wherein the third image comprises a second polygon that surrounds the first polygon of the second image.

4. The apparatus of claim 1, wherein the control unit is configured to vary the size of the image projected onto the lens to change between 1 minute of angle (MOA) and 6 MOA.

5. The apparatus of claim 1, further comprising:
a user interface coupled to the control unit and configured to receive a user input,
wherein the control unit is configured to vary the size of the image projected onto the lens by the light source based on the user input.

6. An apparatus implementable on a firearm, comprising:
a lens;
a light source configured to project an image of an aim point onto the lens; and
a control unit coupled to the light source,
wherein, in different modes, the control unit is configured to control the light source to light up different portions thereof to vary a size of the image projected onto the lens by the light source without changing a shape of the image,
wherein the control unit is configured to control the light source to perform operations comprising:
in a first mode, projecting a first image as the image of the aim point in a first size;

in a second mode, projecting both of the first image and a second image to form the image of the aim point in a second size larger than the first size; and in a third mode, projecting all of the first image, the second image and a third image to form the image of the aim point in a third size larger than the second size, wherein the second image surrounds the first image such that a combination of the first image and the second image forms a silhouette of the first image in the second size, and wherein the third image surrounds the second image such that a combination of the first image, the second image and the third image forms the silhouette of the image of the aim point in the third size.

7. The apparatus of claim 6, wherein the light source comprises on single light-emitting diode (LED).

8. The apparatus of claim 6, wherein the first image comprises a dot, wherein the second image comprises a first circle or a first hollowed dot that surrounds the dot of the first image, and wherein the third image comprises a second circle or a second hollowed dot that surrounds the first circle or the first hollowed dot of the second image.

9. The apparatus of claim 8, wherein the first image comprises a polygon, wherein the second image comprises a first hollowed dot that surrounds the polygon of the first image, and wherein the third image comprises a second polygon that surrounds the first polygon of the second image.

10. The apparatus of claim 6, wherein the control unit is configured to vary the size of the image projected onto the lens to change between 1 minute of angle (MOA) and 6 MOA.

11. The apparatus of claim 6, further comprising:

a user interface coupled to the control unit and configured to receive a user input, wherein the control unit is configured to vary the size of the image projected onto the lens by the light source based on the user input.

* * * * *